United States Patent [19]

Weber et al.

[11] Patent Number: 5,045,423

[45] Date of Patent: Sep. 3, 1991

[54] TONER AND DEVELOPER COMPOSITIONS WITH CHARGE ENHANCING ADDITIVES

[75] Inventors: Joseph R. Weber, Rochester; Edward J. Gutman, Webster; John R. Laing, Rochester; John L. Haack, Pittsford, all of N.Y.

[73] Assignee: Xerox Corporation, Stamford, Conn.

[21] Appl. No.: 531,739

[22] Filed: Jun. 1, 1990

[51] Int. Cl.[5] ..... G03G 9/08

[52] U.S. Cl. ..... 430/110; 430/106.6; 430/115; 524/904

[58] Field of Search ..... 430/106.6, 110, 115; 524/904

[56] References Cited

U.S. PATENT DOCUMENTS

| | | | |
|---|---|---|---|
| 4,338,390 | 7/1982 | Lu | 430/106 |
| 4,560,635 | 12/1985 | Hoffend et al. | 430/106.6 |
| 4,752,550 | 6/1988 | Barbetta et al. | 430/106.6 |
| 4,894,308 | 1/1990 | Mahabadi et al. | 430/137 |
| 4,904,762 | 2/1990 | Chang et al. | 430/110 |

*Primary Examiner*—John Goodrow

*Attorney, Agent, or Firm*—E. O. Palazzo

[57] ABSTRACT

A toner composition comprised of resin particles, pigment particles, and bis-(distearyldimethylammonium)-sulfate.

37 Claims, No Drawings

TONER AND DEVELOPER COMPOSITIONS WITH CHARGE ENHANCING ADDITIVES

BACKGROUND OF THE INVENTION

The invention is generally directed to toner and developer compositions, and more specifically, the present invention is directed to developer and toner compositions containing charge enhancing additives, which impart or assist in imparting a positive charge to the toner resin particles and enable toners with rapid admix characteristics. In one embodiment, there are provided in accordance with the present invention toner compositions comprised of resin particles, pigment particles, and certain quaternary ammonium sulfates, including preferably bis or di distearyldimethylammoniumsulfate $[DD'A)_2SO_4)]$ wherein D is distearyl and D' is dimethyl, charge enhancing additives, which additives enable, for example, toners with rapid admix of less than about 15 seconds in some embodiments, extended developer life, stable electrical properties, high image print quality with substantially no background deposits, and compatibility with fuser rolls including Viton fuser rolls. With further regard to admix, the toners of the present invention in an embodiment thereof had excellent admix of times less than or equal to 15 seconds as determined by a charge spectrograph. The aforementioned toner compositions usually contain pigment particles comprised of, for example, carbon black, magnetites, or mixtures thereof, cyan, magnenta, yellow, blue, green, red, or brown components, or mixtures thereof thereby providing for the development and generation of black and/or colored images. The toner compositions of the present invention possess excellent admix characteristics as indicated herein, and maintain their triboelectric charging characteristics for an extended number of imaging cycles. The toner and developer compositions of the present invention can be selected for electrophotographic, especially xerographic imaging and printing processes, including color processes.

Developer compositions with charge enhancing additives, which impart a positive charge to the toner resin, are well known. Thus, for example, there is described in U.S. Pat. No. 3,893,935 the use of quaternary ammonium salts as charge control agents for electrostatic toner compositions. In this patent, there are disclosed quaternary ammonium compounds with four R substituents on the nitrogen atom, which substituents represent an aliphatic hydrocarbon group having 7 or less, and preferably about 3 to about 7 carbon atoms, including straight and branch chain aliphatic hydrocarbon atoms, and wherein X represents an anionic function including, according to this patent, a variety of conventional anionic moieties such as halides, phosphates, acetates, nitrates, benzoates, methylsulfates, perchloride, tetrafluoroborate, benzene sulfonate, and the like; U.S. Pat. No. 4,221,856 which discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example, sulfate, sulfonate, nitrate, borate, chlorate, and the halogens such as iodide, chloride and bromide, reference the Abstract of the Disclosure and column 3; a similar teaching is presented in U.S. Pat. No. 4,312,933 which is a division of U.S. Pat. No. 4,291,111; and similar teachings are presented in U.S. Pat. No. 4,291,112 wherein A is an anion including, for example, sulfate, sulfonate, nitrate, borate, chlorate, and the halogens. There are also described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica.

Also, there is disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Further, there is disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other documents disclosing positively charged toner compositions with charge control additives include U.S. Pat. Nos. 3,944,493; 4,007,293; 4,079,014 and 4,394,430.

A patentability search report in a related copending application recited the following prior art, all U.S. Pat. No. 4,812,381 relating to toners and developers with quaternary ammonium salts of the formula illustrated in column 3, the preparation thereof, see column 4, and also note the working examples, columns 7 and 8, wherein specific charge additives, such as octadecyl ammonium trifluoromethane sulfonate, are reported; U.S. Pat. No. 4,675,118 which discloses certain quaternary salts as fabric softeners, see the Abstract of the Disclosure, and note column 1, for example, wherein X is as recited including $OSO_3CH_3$ and halide; U.S. Pat. No. 4,752,550, the disclosure of which is totally incorporated herein by reference, directed to toners and developers with inner salt charge, see for example column 4; U.S. Pat. No. Re. 32,883 (a reissue of U.S. Pat. No. 4,338,390), the disclosures of which are totally incorporated herein by reference, wherein toners with organic sulfonate and organic sulfate charge enhancing additives are illustrated, see columns 3, 4, and 5 to 10 for example; and U.S. Pat. No. 4,058,585 which discloses a process of extracting metals with organic solvent solutions of the salts of hydrogen ionic exchange agents, and quaternary ammonium compounds including bisulfates. Processes for preparing quaternary ammonium salts by an ion exchange, or ion pair extraction method with soluble quaternary compounds is known, reference for example Phase Transfer Catalysis, Principles and Techniques, Academic Press, N.Y., 1978, especially page 76, C. M. Starks and C. Liotta, the disclosure of this textbook being totally incorporated herein by reference, and "Preparative Ion Pair Extraction", Apotekarsocieteten/Hassle, Lakemidel, pages 139 to 148, Sweden, 1974, which illustrates the preparation of certain bisulfates with water soluble ammonium salt reactants and a two-phase method wherein the product resides in the water phase.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There is illustrated in U.S. Pat. No. 4,404,271 a complex system for developing electrostatic images with a toner which contains a metal complex represented by the formula in column 2, for example, and wherein ME can be chromium, cobalt or iron. Additionally, other patents disclosing various metal containing azo dyestuff structures wherein the metal is chromium or cobalt include U.S. Pat. Nos. 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with chromium and cobalt complexes of azo dyes as negative charge enhancing additives.

Other prior art includes Japanese Publication No. 54-145542 which illustrates a negatively chargeable toner consisting of a resin, a colorant, and the charge control agent pyridoxine aliphatic acid ester; East German Patent Publication 218697 relating to liquid developers with charge control additives with structural units of Formulas (I), (II) and (III), and which contains olefinically polymerizable bonds; U.S. Pat. No. 3,850,642 relating to multilayer sensitive elements with ionizable salts, acids, esters, and surfactants as charge control agents; U.S. Pat. No. 2,970,802 illustrating a composition for the control of hyperchloestermia, which composition consists of a nontoxic gelatin containing aluminum nicotinate; and U.S. Pat. No. 3,072,659 which discloses a method of preparing aluminum salts of nicotinic acid.

In copending application U.S. Pat. No. 4,937,157, the disclosure of which is totally incorporated herein by reference, there are illustrated toner compositions comprised of resin, pigment, or dye, and tetraalkyl, ammonium salts wherein alkyl, for example, contains from 1 to about 30 carbon atoms, ammonium bisulfate charge enhancing additives such as distearyl dimethyl ammonium bisulfate, tetramethyl ammonium bisulfate, tetraethyl ammonium bisulfate, tetrabutyl ammonium bisulfate, and preferably dimethyl dialkyl ammonium bisulfate compounds where the dialkyl radicals contain from about 10 to about 30 carbon atoms, and more preferably dialkyl radicals with from about 14 to about 22 carbon atoms, and the like. The aforementioned charge additives can be incorporated into the toner or may be present on the toner surface. Advantages of rapid admix, appropriate triboelectric characteristics, and the like are achieved with many of the toners of the aforementioned patent according to the disclosure thereof.

Preferred quaternary ammonium bisulfates disclosed in the aforementioned copending application are of the formula $R'_2R''_2N^+X^-(R_4N)^+X^-$ wherein R' is aryl, substituted aryl such as alkylaryl, alkyl, preferably with 1 to about 30 carbon atoms, such as methyl, ethyl, propyl, butyl, hexyl, heptyl, and preferably dimethyl dialkyl ammonium bisulfate compounds where the dialkyl radicals are from about 10 to about 30 carbon atoms, and more preferably dialkyl radicals with from about 14 to about 22 carbon atoms; R'' is aryl, substituted aryl such as alkylaryl, alkyl, preferably containing from 1 to about 18 carbon atoms; and $X^-$ is a bisulfate ($HSO_4$) anion.

Disclosed in copending application U.S. Ser. No. 396,497 , filed Aug. 21, 1989, is the compound distearyl dimethyl ammonium bisulfate and toner compositions thereof.

Disclosed in U.S. Pat. No. 4,904,762 , filed Aug. 21, 1989, is a toner composition comprised of resin, pigment, and a mixture of charge enhancing additives comprised of a first additive of quaternary ammonium salts and a second additive of an alkyl ammonium bisulfate.

Although many charge enhancing additives are known, there continues to be a need for toners with additives, which toners possess many of the advantages illustrated herein. Additionally, there is a need for positive charge enhancing additives which are useful for incorporation into black, and/or colored toner compositions. Moreover, there is a need for colored toner compositions containing certain charge enhancing additives. There is also a need for toner compositions with certain charge enhancing additives, which toners possess acceptable substantially stable triboelectric charging characteristics, and excellent admixing properties. Moreover, there continues to be a need for positively charged toner and developer compositions. Further, there is a need for toners with certain charge enhancing additives which can be easily and permanently dispersed into toner resin particles. There also is a need for positively charged black, and colored toner compositions that are useful for incorporation into various imaging processes, inclusive of color xerography, as illustrated in U.S. Pat. No. 4,078,929, the disclosure of which is totally incorporated herein by reference, laser printers, and additionally a need for toner compositions useful in imaging apparatuses having incorporated therein layered photoresponsive imaging members, such as the members illustrated in U.S. Pat. No. 4,265,990, the disclosure of which is totally incorporated herein by reference. Also, there is a need for toner compositions which have the desired triboelectric charge level, for example, from about 10 to about 40 microcoulombs per gram, and preferably from about 10 to about 20 microcoulombs per gram, and admix charging rates of from about 5 to about 60 seconds, and preferably less than about 15 seconds, as determined by the charge spectrograph, preferably for example at low concentrations, that is for example less than 1 percent, and preferably less than about 0.5 percent of the charge enhancing additive of the present invention. It is believed that the sulfate anion of the charge additives of the present invention contributes to the desirable toner admix characteristics mentioned herein, and that the cationic segment influences the toner minimum fix temperature. Also, it is believed that the triboelectric charge of the toner is apparently more dependant on the cation segment. Further, the cation and anion segment together offer, it is believed, the capability to independently adjust or modify the toner triboelectric charge and admix by, for example, adjusting the amount selected. In admixtures with other charge additives, such as distearyldimethylammonium bisulfate, the ratio thereof can effect the toner triboelectric charge and admix characteristics independent of each other.

SUMMARY OF THE INVENTION

It is an object of the present invention to provide toner and developer compositions with charge enhancing additives.

In another object of the present invention there are provided positively charged toner compositions useful for the development of electrostatic latent images including color images.

In yet another object of the present invention there are provided positively charged toner compositions containing quaternary ammonium sulfates, especially bis-(distearyldimethylammonium) sulfate, $(DD'A)_2+SO_4=$, charge enhancing additives wherein D and D' are as defined herein.

Also, in another object of the present invention there are provided developer compositions with positively charged toner particles, carrier particles, and bis-(distearyldimethylammonium) sulfate charge enhancing additives.

In yet a further object of the present invention there are provided humidity insensitive, from about, for example, 20 to 80 percent relative humity at temperatures of from 60° to 80° F. as determined in a relative humidity testing chamber, positively charged toner compositions with desirable admix properties of 5 seconds to 60 seconds as determined by the charge spectrograph, and preferably less than 15 seconds for example, and more preferably from about 1 to about 14 seconds, and acceptable triboelectric charging characteristics of from about 10 to about 40 microcoulombs per gram.

Additionally, in a further object of the present invention there are provided positively charged magnetic toner compositions, and positively charged colored toner compositions containing therein, or thereon bis-(distearyldimethylammonium) sulfate charge additives.

Furthermore, in yet another object of the present invention there are provided toner and developer compositions with di- or bis-(distearyldimethylammonium) sulfate, which compositions are useful in a variety of electrostatic imaging and printing processes, including color xerography, and wherein the admix charging times are less than 60 seconds.

In another object of the present invention that are provided thermally stable bis-(distearyldimethylammonium) sulfate charge enhancing additives, that is for example additives which do not decompose at high temperatures, for example, of from about 100° to about 150° C.

Another object of the present invention resides in the formation of toners which will enable the developement of images in electrophotographic imaging apparatuses, which images have substantially no background deposits thereon, are substantially smudge proof or smudge resistant, and therefore are of excellent resolution; and further, such toner compositions can be selected for high speed electrophotographic apparatuses, that is those exceeding 70 copies per minute.

These and other objects of the present invention are accomplished in embodiments thereof by providing toner compositions comprised of resin particles, pigment particles, and certain quaternary ammonium sulfate charge enhancing additives. More specifically, the present invention is directed to toner compositions comprised of resin, pigment, or dye, and bis-(distearyldimethylammonium) sulfate. The aforementioned charge additives can be incorporated into the toner or may be present on the toner surface. Advantages of rapid admix, appropriate triboelectric characteristics, and the like are achieved with many of the toners of the present invention.

The charge control additive compounds of the present invention are believed to be available, however, they can be prepared by a number of methods, such as for example by the hydroylsis/disproportionation of distearyl dimethyl ammonium bisulfate. In one embodiment the charge additive bis- or di-(distearyldimethylammonium) sulfate $(DD'A)_2+SO_4=$ of the present invention can be prepared by the ion exchange of 50 weight by volume percent distearyl dimethyl ammonium bromide, distearyl dimethyl ammonium chloride, distearyl dimethyl ammonium methyl sulfate, or other salts of the distearyl dimethyl ammonium cation and a monovalent anion in a water immiscible solvent in which the bis-(distearyldimethylammonium) sulfate is soluble, such as methyl ethyl ketone or other water immiscible solvents in which the $(DD'A)_2+SO_4=$ is soluble at temperatures below the boiling point of either water or the solvent, but at least soluble at, for example, specifically 46° C. with one and one half to ten molar excess of sodium, potassium or ammonium sulfate based on the DD'A cations and about a tenfold excess of water based on the solvent volume is suspended by rapid stirring at 46° C. to 60° C. for one half hour, followed by separation of the water and solvent phases while still warm (at least 46° C.) and recovering the product $(DD'A)_2+SO_4=$ from the solvent phase by evaporating the solvent. $(DD'A)_2+SO_4=$ also may be prepared by neutralization of the distearyl dimethyl ammonium hydroxide with an equimolar amount of distearyl dimethyl ammonium bisulfate, and by other similar known methods. $(DD'A)_2+SO_4=$ also may be prepared by the hydrolysis/disproportionation of 50 percent weight by volume distearyl dimethyl ammonium bisulfate (DDABS) in a water miscible solvent such as isopropanol, acetone, tetrahydrofuran and mixtures of those solvents at about 46° C. by precipitating the $(DD'A)_2+SO_4=$ by quenching the solvent solution of DDABS into a tenfold excess of rapidly stirring cold (20° C.) water.

The toner compositions of the present invention can be prepared by a number of known methods such as admixing and heating resin particles such as styrene butadiene copolymers, pigment particles such as magnetite, carbon black, or mixtures thereof, and an effective amount of charge additive, for example, preferably from about 0.1 percent to about 5 percent of the aforementioned charge enhancing additives in a toner extrusion device, such as the ZSK53 available from Werner Pfleiderer, and removing the formed toner composition from the device. Subsequent to cooling, the toner composition can be subjected to known grinding processes utilizing, for example, a Sturtevant micronizer for the purpose of achieving toner particles with a volume median diameter of less than about 25 microns, and preferably of from about 8 to about 12 microns, which diameters are determined by a Coulter Counter. Subsequently, the toner compositions can be classified utilizing, for example, a Donaldson Model B classifier for the purpose of removing fines, that is toner particles less than about 4 microns volume median diameter. Other methods, including Banbury melt mixing, can be selected for the preparation of the toners of the present invention. For the known Banbury rubber mill the heating temperature is preferably about 85° C., and for extrusion the toner melt temperature is about 215° C. in an embodiment of the present invention.

Illustrative examples of suitable toner resins selected for the toner and developer compositions of the present invention include polyamides, polyolefins, epoxies, styrene acrylates, styrene methacrylates, styrene butadienes, such as Pliolites available from Goodyear Chemical Company, polyurethanes, vinyl resins, including homopolymers or copolymers of two or more vinyl monomers; and polymeric esterification products of a dicarboxylic acid and a diol comprising a diphenol. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butylacryllate, isobutyl acrylte, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like, reference the U.S. patents mentioned herein, the disclosures of which have been totally incoporated herein by reference.

As one toner resin, there are selected the esterification products of a dicarboxylic acid and a diol comprising a diphenol. These resins are illustrated in U.S. Pat. No. 3,590,000, the disclosure of which is totally incorporated herein by reference. Other toner resins include styrene/methacrylate copolymers (58/42) and styrene/-butadiene copolymers (89/11; 91/9); Pliolites; emulsion polymerized styrene butadienes, reference U.S. Pat. No. 4,469,770, the disclosure of which is totally incorporated herein by reference; suspension polymerized styrene butadienes, reference U.S. Pat. No. 4,558,108, the disclosure of which is totally incorporated herein by reference; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol, styrene acrylates, and mixtures thereof. Also, waxes with a molecular weight of from about 1,000 to about 6,000, such as polyethylene, polypropylene, and paraffin waxes, can be included in or on the toner compositions as fuser roll release agents.

The resin particles are present in a sufficient, but effective amount, for example from about 70 to about 90 weight percent. Thus, when 1 percent by weight of the charge enhancing additive is present, and 10 percent by weight of pigment or colorant, such as carbon black, is contained therein, about 89 percent by weight of resin is selected. Also, the charge enhancing additive of the present invention may be coated on the pigment particle. When used as a coating, the charge enhancing additive of the present invention is present in an amount of from about 0.1 weight percent to about 5 weight percent, and preferably from about 0.3 weight percent to about 1 weight percent.

Numerous well known suitable pigments or dyes can be selected as the colorant for the toner particles including, for example, carbon black, nigrosine dye, aniline blue, magnetite, or mixtures thereof. The pigment, which is preferably carbon black, should be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition; however, lesser or greater amounts of pigment particles may be selected.

When the pigment particles are comprised of magnetites, thereby enabling single component toners in some instances, which magnetites are a mixture of iron oxides ($FeO.Fe_2O_3$) including those commercially available as Mapico Black, they are present in the toner composition in an amount of from about 10 percent by weight to about 70 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as Mapico Black, in an amount of, for example, from about 5 to about 60, and preferably from about 10 to about 50 weight percent, can be selected.

There can also be blended with the toner compositions of the present invention external additive particles including flow aid additives, which additives are usually present on the surface thereof. Examples of these additives include colloidal silicas such as Aerosil, metal salts and metal salts of fatty acids inclusive of zinc stearate, aluminum oxides, cerium oxides, and mixtures thereof, which additives are generally present in an amount of from about 0.1 percent by weight to about 5 percent by weight, and preferably in an amount of from about 0.1 percent by weight to about 1 percent by weight. Several of the aforementioned additives are illustrated in U.S. Pat. Nos. 3,590,000 and 3,800,588, the disclosures of which are totally incorporated herein by reference.

With further respect to the present invention, colloidal silicas such as Aerosil can be surface treated with the charge additives of the present invention illustrated herein in an amount of from about 1 to about 30 weight percent and preferably 10 weight percent followed by the addition thereof to the toner in an amount of from 0.1 to 10 and preferably 0.1 to 1 weight percent.

Also, there can be included in the toner compositions of the present invention low molecular weight waxes, such as polypropylenes and polyethylenes commerically available from Allied Chemical and Petrolite Corporation, Epolene N-15 commercially available from Eastman Chemical Products, Inc., Viscol 550-P, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 5,000. Many of the polyethylene and polypropylene compositions useful in the present invention are illustrated in British Patent 1,442,835, the disclosure of which is totally incorporated herein by reference.

The low molecular weight wax materials are present in the toner composition of the present invention in various amounts, however, generally these waxes are present in the toner composition in an amount of from about 1 percent by weight to about 15 percent by weight, and preferably in an amount of from about 2 percent by weight to about 10 percent by weight.

Encompassed within the scope of the present invention are colored toner and developer compositions comprised of toner resin particles, carrier particles, the charge enhancing additives illustrated herein, and as pigments or colorants red, blue, green, brown, magenta, cyan and/or yellow particles, as well as mixtures thereof. More specifically, with regard to the generation of color images utilizing a developer composition with the charge enhancing additives of the present invention, illustrative examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra-4-(octadecyl sulfonamido) phthalocyanine, X-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts. In one embodiment, these colored pigment particles are present in the toner composition in an amount of from about 2 percent by weight to about 15 percent by weight calculated on the weight of the toner resin particles.

For the formulation of developer compositions, there are mixed with the toner particles carrier components, particularly those that are capable of triboelectrically assuming an opposite polarity to that of the toner composition. This mixing can be accomplished by known methods including mixing of the components in a roll mill, a Lodige blender, a ball mill, a twin shell mixer, and the like for an effective period of time of, for example, from about 1 to about 120 minutes. Accordingly, the carrier particles of the present invention are selected to be of a negative polarity enabling the toner particles, which are positively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in one embodiment in an amount of from about 0.1 to about 3 weight percent, conductive substances such as carbon black in an amount of from about 5 to about 30 percent by weight. Polymer coatings not in close proximity in the triboelectric series can also be selected, reference U.S. Pat. Nos. 4,937,166 and 493,532 the disclosures of which are totally incorporated herein by reference, including for example Kynar and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 1,000 microns thereby permitting them to possess sufficient density and inertia to avoid adherence to the electrostatic images during the development process. The carrier component can be mixed with the toner composition in various suitable combinations, however, best results are obtained when about 1 to 5 parts per toner to about 10 parts to about 200 parts by weight of carrier are selected.

The toner composition of the present invention can be prepared by a number of known methods as indicated herein including extrusion melt blending the toner resin particles, pigment particles or colorants, and the charge enhancing additive of the present invention as indicated herein, followed by mechanical attrition. Other methods include those well known in the art such as spray drying, melt dispersion, extrusion processing, dispersion polymerization, and suspension polymerization. Also, as indicated herein the toner composition without the charge enhancing additive can be prepared, followed by the addition of surface treated with charge additive colloidal silicas. Further, other methods of preparation for the toner are as illustrated herein.

The toner and developer compositions of the present invention may be selected for use in electrostatographic imaging apparatuses containing therein conventional photoreceptors providing that they are capable of being charged negatively. Thus, the toner and developer compositions of the present invention can be used with layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys. Other similar photoreceptors can be selected providing the objectives of the present invention are achievable.

It is known that the toner compositions are usually jetted and classified subsequent to preparation to enable toners with an average diameter of from about 5 to about 25 microns, and more preferably from about 8 to about 12 microns. Also, the toner compositions of the present invention preferably possess a triboelectric charge to diameter ratio of from about 0.1 to about 2 femtocoulombs per micron as determined by the known charge spectograph. Admix time for the toners of the present invention are preferably from about 5 seconds to 1 minute, and more specifically from about 5 to about 15 seconds as determined by the known charge spectograph. These toner compositions with rapid admix characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 70 copies per minute. With further respect to the present invention, a preferred developer composition is comprised of a toner composition containing the charge enhancing additive, pigment particles such as carbon black, resin particles, and carrier particles comprised of a core containing thereover a plurality and preferably two polymeric coatings, namely a first polymeric coating and a second polymeric coating, which coatings are not in close proximity in the triboelectric series, reference U.S. Pat. Nos. 4,937,166 and 4,935,326, both entitled "Developer Compositions For Coated Carrier Particles", the disclosures of each of these applications being totally incorporated herein by reference. With the aforementioned carriers, in some embodiments from about 0.1 to about 0.5 weight percent of the charge enhancing additive can be selected. Accordingly, for example, small amounts of charge enhancing additives can be selected for developers with carrier particles containing a double polymeric coating thereover.

Also, the toner compositions of the present invention possess desirable narrow charge distributions, optimal triboelectric charging values, preferably of from about 10 to about 40, and more preferably from about 10 to about 35 microcoulombs per gram with from about 0.1 to about 5 weight percent in one embodiment of the charge enhancing additive; and rapid admix charging times as determined in the charge spectrograph of less than 15 seconds, and more perferably in some embodiments from about 1 to about 14 seconds.

The following examples are being supplied to further define various species of the present invention, it being noted that these examples are intended to illustrate and not limit the scope of the present invention. Parts and percentages are by weight unless otherwise indicated.

EXAMPLE I

Chemical Synthesis of Bis-(Distearyl Dimethyl Ammonium) Sulfate $(DD'A)_2+SO_4=$ by the Neutraliztion of Distearyl Dimethyl Ammonium Bisulfate (DDABS):

To a rapidly stirring mixture of 50 milliliters of deionized water and 50 milliliters of n-butanol there was added 1 millimole, 646 milligrams, of (DDABS) and about 3 millimoles, 168 milligrams, of potassium hydroxide. The two layers formed were allowed to separate and the upper layer of n-butanol was removed by decantation. Subsequently, there was added to the butanol extract in increments a solution of 1 millimole of DDABS in 50 milliliters of n-butanol until the resulting solution tested neutral to pH paper moistened with water. The product $(DD'A)_2+SO_4=$, bis-(distearyl dimethyl ammonium) sulfate, was obtained by evaporation of the n-butanol solvent followed by drying under a vacuum at about 50° C. until free of trace elements, such as potassium, as determined by a Dionex TM (cation) Ion Chromatograph.

EXAMPLE II

Chemical Synthesis of Bis-(Distearyl Dimethyl Ammonium) Sulfate $(DD'A)_2+SO_4=$ by the Phase Transfer Ion Exchange Method:

To 1,000 milliliters of 2 parts by weight of methyl ethyl ketone and 8 parts of deionized water there were added about 50 grams, about 0.8 millimole, of distearyl dimethyl ammonium methyl sulfate, and while stirring rapidly, subsequently adding 20 grams of potassium sulfate. The aforementioned resulting mixture was then heated to 46° C. with stirring for 30 minutes. Two phases separated without cooling and the solvent methyl ethyl ketone upper layer phase was decanted. The above desired product was recovered by evaporating the solvent and drying under a vacuum at about 50° C. until substantially free of the solvent of methyl ethyl ketone as determined gas chromatography or by odor since one can detect parts per million levels of methyl ethyl ketone.

EXAMPLE III

Chemical Synthesis of Bis- or Di-(Distearyl Dimethyl Ammonium) Sulfate $(DD'A)_2+SO_4=$ by the Hydrolysis/disproportionation of Distearyl Dimethyl Ammonium Bisulfate (DDABS):

To 50 grams of DDABS, distearyl dimethyl ammonium bisulfate, there were added 100 milliliters of isoproponal solvent followed by heating in a reaction flask to 46° C. with stirring until a clear solution was formed. The resulting clear solution was then poured into 900 milliliters of rapidly stirring cold (20° C.) deionized water, and stirring was continued for 20 minutes. Subsequently, the solids were filtered through a number 41 Whatman paper, and the solids resulting were redissloved in isopropanol at 46° C. as indicated above. The resulting solution was then poured into 900 milliliters of rapidly stirring cold (20° C.) deionized water, and stirring was continued for 20 minutes. Subsequently, the solids were filtered through a number 41 Whatman paper and rinsed with 500 milliliters of cold (20° C.), 10 volume percent, isopropanol in deionized water. The above desired product was recovered by evaporating the solvent and drying under a vacuum at about 50° C. until substantially free of solvent, reference Example II. The product was bis- or di-(distearyl dimethyl ammonium) sulfate as determined by infrared analysis, and acidity titration.

Based on the starting material, DDABS, distearyl dimethyl ammonium bisulfate, and the product $(DD'A)_2+SO_4=$, titration of $(DD'A)_2+SO_4=$ with a standard base (0.1N NaOH, Fisher Chemicals) should yield a titer equal to the blank so that when the blank is substracted a titer of $0.00+/-0.005$ percent as sulfuric acid should be obtained. The percent of $H_2SO_4=[(mL\text{-}titer\text{-}mLblank\ titer)\times(NNaOH)\times(98\ mg/mmole)\times(100\ parts\ per\ 100\ parts)]\div[(1{,}000\ mg/g)\times(grams\ sample\ wt.)]$ (Theoretical acidity is therefore 0.00 percent as $H_2SO_4$). Titration of a sample of the product as prepared above was found to be 0.5 percent by weight as sulfuric acid.

Also, based on the formula $C_{76}H_{168}N_2SO_4$ one can calculate the molar equivalency and weight percent of sulfate anion in the above prepared product compound. Theoretical percent by weight of $SO_4=[SO_4\ au]\div[C_{76}H_{168}N2_5O_4\ au]\times 100$. Using the IUPAC molecular weight scale, to the nearest 0.5 au, the theoretical sulfate content of $(DD'A)_2+SO_4=$ to the nearest 0.01 percent was 8.04 percent by weight. The measurement was made on a Dionex TM Ion Chromatograph being run in the anion mode. The above prepared product was found to contain 9.1 percent by weight $SO_4$ anion.

Infrared spectra were obtained for the above prepared product on a Nicolet 60 SX Fourier Transform Infrared Spectrometer (FT-IR), and compared to a collection of known alkali and quaternary ammonium sulfates (Aldrich-Nicolet Library of Fourier Transform Infrared Spectra) as well as to the starting DDABS, and was judged to be the targeted compound $(DD'A)_2.+SO_4=$.

EXAMPLE IV

There was prepared in an extrusion device, available as ZSK53 from Werner Pfleiderer, a toner composition by adding thereto 80.13 percent by weight of suspension polymerized styrene butadiene copolymer resin particles (87/13), reference U.S. Pat. No. 4,558,108, the disclosure of which is totally incorporated herein by reference; 16.4 percent by weight of the magnetite Mapico Black; 3.15 percent by weight of Regal 330® carbon black; and 0.32 percent by weight of bis- or di-(distearyldimethylammonium) sulfate charge enhancing additive of Example III. The toner was extruded at a rate of 220 pounds per hour with a temperature setting to achieve a melt temperature of 447° F. Thereafter, the toner product was cut into pellets with a knife, and cooled in a water bath. Subsequently, the resulting toner was subjected to grinding in a Sturtevant micronizer enabling toner particles with a volume median diameter of from 8 to 12 microns as measured by a Coulter Counter. Thereafter, the aforementioned toner particles were classified in a Donaldson Model B classifier for the purpose of removing fine particles, that is those with a volume median diameter of less than 4 microns.

Subsequently, the above formulated toner, 3 parts by weight, was mixed with 97 parts by weight of a carrier containing a steel core with a polymer mixture thereof, 0.70 percent by weight, which polymer mixture contained 40 parts by weight of polyvinylidene fluoride and 60 parts by weight of polymethyl methacrylate, and wherein mixing was accomplished in a paint shaker for 10 minutes. There resulted on the toner composition, as determined in the known Faraday Cage apparatus, a positive triboelectric charge of 17 microcoulombs per gram.

There was then added to the above prepared developer composition 1 part by weight of a substantially uncharged toner comprised of 80.13 percent by weight of suspension polymerized styrene butadiene copolymer resin particles (87/13), reference U.S. Pat. No. 4,558,108, the disclosure of which is totally incorporated herein by reference; 16.4 percent by weight of the magnetite Mapico Black; 3.15 percent by weight of Regal 330® carbon black; and 0.32 percent by weight of the charge enhancing additive di- or bis-(distearyldimethylammonium) sulfate of Example III. Thereafter, the charge distribution of the resulting developer was measured as a function of the mixing time, and it was determined by a charge spectrograph that the admixing time was less than 15 seconds for the added uncharged toner, which is the shortest time that was measured on the toner.

When a toner composition and developer composition are prepared by repeating the above procedures, and there is selected in place of the above charge enhancing additive, the charge enhancing additive distearyl dimethyl ammonium methyl sulfate, the admix time was more than 15 seconds but less than 30 seconds.

EXAMPLE V

There was prepared in a Banbury device a toner composition by adding thereto 80.13 percent by weight of suspension polymerized styrene butadiene copolymer resin particles (87/13), reference U.S. Pat. No. 4,558,108, the disclosure of which is totally incorporated herein by reference; 16.4 percent by weight of the magnetite Mapico Black; 3.15 percent by weight of Regal 330® carbon black; and 0.32 percent by weight of the charge enhancing additive di-(distearyldimethylammonium) sulfate obtained by the process of Example III. On exiting the Banbury, the toner product was placed in a roll mill for 5 minutes at a spacing of 100 millimeters. Subsequently, the toner was subjected to grinding in a Sturtevant micronizer enabling toner particles with a volume median diameter of from 8 to 12 microns as measured by a Coulter Counter. Thereafter, the aforementioned toner particles were classified in a Donaldson Model B classifier for the purpose of removing fine particles, that is those with a volume median diameter of less than 4 microns.

Subsequently, the above formulated toner, 3 parts by weight, was mixed with 97 parts by weight of a carrier containing a steel core with a polymer mixture thereof, 0.70 percent by weight, which polymer mixture contained 50 parts by weight of polyvinylidene fluoride, and 50 parts by weight of polymethyl methacrylate, and wherein mixing was accomplished in a paint shaker for 10 minutes. There resulted on the toner composition, as determined in the known Faraday Cage apparatus, a positive triboelectric charge of 15 microcoulombs per gram.

There was then added to the above prepared developer composition 1 part by weight of a toner comprised of 80.13 percent by weight of suspension polymerized styrene butadiene copolymer resin particles (87/13), reference U.S. Pat. No. 4,558,108, the disclosure of which is totally incorporated herein by reference; 16.4 percent by weight of the magnetite Mapico Black; 3.15 percent by weight of Regal 330® carbon black; and 0.32 percent by weight of the charge enhancing additive di-(distearyldimethylammonium) sulfate of Example III. Thereafter, the charge distribution of the resulting developer was measured as a function of the mixing time, and it was determined by a charge spectrograph that the admixing time was less than 15 seconds for the added uncharged toner determined in accordance with the procedure of Example IV.

When a toner composition and developer composition were prepared by repeating the process of Example V with the exception that there was selected in place of the $(DD'A)_2+SO_4$=charge additive, the charge additive distearyl dimethyl ammoniun methyl sulfate, the admix time was about 60 seconds.

In an embodiment, there are provided toner compositions with charge enhancing additives of the formula $(R_1R_2NR_3R_4)+_2SO_4$=wherein each R is independently alkyl of, for example, from 1 to about 20 carbon atoms, such as methyl, ethyl, propyl, butyl, pentyl, hexyl, octyl, and the like, or aryl of, for example, from 6 to about 24 carbon atoms, such as phenyl, naphthyl, and the like. In the aforementioned formula, each of the R substituents are bonded to the nitrogen atom.

Other modifications of the present invention may occur to those skilled in the art subsequent to a review of the present application, and these modifications, including equivalents thereof, are intended to be included within the scope of the present invention.

What is claimed is:

1. A toner composition comprised of resin particles, pigment particles, and bis-(distearyldimethylammonium) sulfate.

2. A toner composition comprised of resin, pigment or dye particles, and a bis-(distearyldimethylammonium) sulfate $(DD'A)_2+SO_4$=wherein D is distearyl and D' is dimethyl.

3. A toner composition in accordance with claim 1 wherein the sulfate is of the formula $(DD'A)_2+SO_4$=-wherein D is distearyl and D' is dimethyl.

4. A toner composition in accordance with claim 2 wherein the charge additive is present in an amount of from about 0.05 to about 5 weight percent.

5. A toner composition in accordance with claim 2 wherein the charge additive is present in an amount of from about 0.1 to about 3 weight percent.

6. A toner composition in accordance with claim 2 wherein the charge additive is incorporated into the toner.

7. A toner composition in accordance with claim 2 wherein the charge additive is present on the surface of the toner composition.

8. A toner composition in accordance with claim 7 wherein the charge additive is contained on colloidal silica particles.

9. A toner composition in accordance with claim 2 with an admix time of from less than about 15 seconds.

10. A toner composition in accordance with claim 2 with an admix time of from about 1 to about 14 seconds.

11. A toner composition in accordance with claim 2 with a triboelectric charge of from about 10 to about 40 microcoulombs per gram.

12. A toner composition in accordance with claim 2 wherein a colloidal silica is treated with the charge enhancing additive, and the resulting composition is present on the surface of the toner.

13. A toner composition in accordance with claim 2 wherein the resin particles are comprised of styrene polymers, polyesters, or mixtures thereof.

14. A toner composition in accordance with claim 2 wherein the resin particles are comprised of styrene acrylates, styrene methacrylates, or styrene butadienes.

15. A toner composition in accordance with claim 2 containing a wax component with a weight average molecular weight of from about 1,000 to about 6,000.

16. A toner composition in accordance with claim 15 wherein the waxy compoenent is selected from the group consisting of polyethylene and polypropylene.

17. A toner composition in accordance with claim 2 containing as external additives metal salts of a fatty acid, colloidal silicas, or mixtures thereof.

18. A toner composition in accordance with claim 2 wherein the pigment particles are carbon black, magnetites, or mixtures thereof, cyan, magenta, yellow, red, blue, green, brown, and mixtures thereof.

19. A developer composition comprised of the toner composition of claim 1 and carrier particles.

20. A developer composition comprised of the toner composition of claim 2 and carrier particles.

21. A developer composition in accordance with claim 20 wherein the carrier particles are comprised of ferrites, steel, or an iron powder.

22. A developer composition in accordance with claim 21 wherein the carrier particles are comprised of a core with a polymer coating thereover.

23. A developer composition in accordance with claim 22 wherein the coating is comprised of a methyl terpolymer, a polyvinylidine fluoride, a polymethyl methacrylate, or a mixture of polymers not in close proximity in the triboelectric series.

24. A method of imaging which comprises formulating an electrostatic latent image on a photoreceptor, affecting development thereof with the toner composition of claim 1, and thereafter transfering the developed image to a suitable substrate.

25. A method of imaging in accordance with claim 24 wherein the transferred image is permanently fixed to the substrate.

26. A method of imaging which comprises formulating an electrostatic latent image on a negatively charged photoreceptor, affecting development thereof with the toner composition of claim 2, and thereafter transferring the developed image to a suitable substrate.

27. A method of imaging in accordance with claim 26 wherein the transferred image is permanently fixed to the substrate.

28. A single component positively charged toner composition comprised of resin particles, magnetite components, and bis-(distearyldimethylammonium)sulfate.

29. A toner composition comprised of resin particles, pigment particles, and a thermally stable bis-(distearyldimethylammonium)sulfate.

30. A toner composition in accordance with claim 29 wherein the charge enhancing additive is stable at high temperatures.

31. A toner composition in accordance with claim 30 wherein the charge enhancing additive is stable at temperatures of from about 100° to about 150° C.

32. A toner comprised of resin particles, pigment particles, and a charge enhancing additive of the formula $(R_1R_2NR_3R_4)+_2SO_4=$ wherein $R_1$, $R_2$, $R_3$, and $R_4$ are independently selected from the group consisting of alkyl and aryl.

33. A toner in accordance with claim 32 wherein alkyl contains from 1 to about 25 carbon atoms.

34. A toner is accordance with claim 32 wherein aryl contains from 6 to 24 carbon atoms.

35. A developer comprised of the toner of claim 32 and carrier particles.

36. A developer in accordance with claim 35 wherein the carrier particles are comprised of a core with a polymeric coating.

37. A process for the preparation of the charge additives of claim 1 which comprises the hydrolysis/disproportionation of distearyl dimethyl ammonium bisulfate.

* * * * *